US005454509A

United States Patent [19]

Bellamy et al.

[11] Patent Number: 5,454,509

[45] Date of Patent: Oct. 3, 1995

[54] MAIL BOX FLAG

[76] Inventors: Charles L. Bellamy, 808 Blue Spruce Ct., Keller, Tex. 76248; James H. Gronwald, 1424 E. Osage Ave., McAlester, Okla. 74501

[21] Appl. No.: 235,885

[22] Filed: May 2, 1994

[51] Int. Cl.[6] ..... B65D 91/00

[52] U.S. Cl. ..... 232/34; 232/39

[58] Field of Search ..... 232/17, 34, 35, 232/38, 39

[56] References Cited

U.S. PATENT DOCUMENTS

| | | | |
|---|---|---|---|
| 1,458,836 | 6/1923 | McDowell . | |
| 2,693,314 | 11/1954 | Hunter | 232/35 |
| 3,081,024 | 3/1963 | Sichler | 232/34 |
| 3,572,581 | 3/1971 | McLeod | 232/35 |
| 4,065,050 | 12/1977 | Hunt | 232/34 |
| 4,113,170 | 9/1978 | Hunsicker | 232/35 |
| 4,151,949 | 5/1979 | Huebener | 232/34 |
| 4,368,842 | 1/1983 | DeLange | 232/17 |
| 4,570,846 | 2/1986 | Morgrey | 232/35 |
| 4,712,732 | 12/1987 | Esopi | 232/35 |
| 4,875,622 | 10/1989 | Lents | 232/39 |
| 4,986,467 | 1/1991 | Bibbee | 232/34 |
| 5,035,356 | 7/1991 | Granger | 232/17 |
| 5,076,337 | 12/1991 | Reuter | 232/35 |
| 5,082,170 | 1/1992 | Goss | 232/35 |

*Primary Examiner*—Flemming Saether
*Attorney, Agent, or Firm*—John E. Vandigriff

[57] ABSTRACT

The invention is to a mail box flag that is constructed to lock the flag in place, and to allow the flag to be raised by moving a lever that holds the free end of the flag. The flag is stored out of sight in a flat rectangular housing that has an outside surface that is constructed, in one example, to resemble a brick.

12 Claims, 3 Drawing Sheets

MAIL BOX FLAG

FIELD OF THE INVENTION

This invention relates to mail box flags, and more particularly to a mail box flag device that may be attached to a mail box, or to a mail box housing, and has a cover that may correspond with the mail box or housing material.

BACKGROUND OF THE INVENTION

Mail boxes usually have flag or signal devices mounted on one side that includes an elongated member pivotally connected to the mail box at one end, and has a signaling device, called a flag, mounted on the other end. The basic purpose of the flag is to alert the person delivering mail that there is mail to be picked up, or to let the mail box owner that there is mail in the box.

Numerous mail box flags have been patented that are automatically released when the mail box door is opened. The flag devices include an elongated member that is pivotally mounted on one to the mail box and has a spring that holds the elongated member in a vertical position. The elongated member is held down in a horizontal position by a clip or other device attached to the mail box door. When the door is opened, the elongated member is released and moved into a vertical position by the spring. The elongated member and the attached flag are visible when in either a horizontal or vertical position. A few representative patents are:

| | | |
|---|---|---|
| 1,458,836 | Mcdowell | June 12, 1923 |
| 2,693,314 | Hunter | November 2, 1954 |
| 3,572,5681 | McLeod | March 30, 1971 |
| 4,065,050 | Hunt | December 27, 1977 |
| 4,11,170 | Hunsicker | September 12, 1978 |
| 4,570,846 | Morgrey | February 18, 1986 |
| 4,986,467 | Bibbee | January 22, 1991 |
| 5,076,337 | Reuter | December 31, 1991 |
| 5,082,170 | Goss | January 21, 1992 |

The above listed patents each have in common, the visibility of the flag in with the flag either up or down, and the releasing of the flag with the mail box door is open.

SUMMARY OF THE INVENTION

The invention is a mail box flag that is constructed to lock the flag in place, and to allow the flag to be raised by moving a lever that holds the free end of the flag. When not raised in a vertical position, the flag is stored out of sight in a flat rectangular housing that has an outside surface that is constructed, in one example, to resemble a brick. This permits the flag housing to be mounded on the outside of a brick mailbox housing, and not be readily visible until the flag is raised.

The outside surface of the flag housing can be made of any material to match the outside of the mail box or mail box covering. Also, if desirable, the out side of the housing may have a reflector surface. The housing cover is changeable so that a selected cover may be used.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
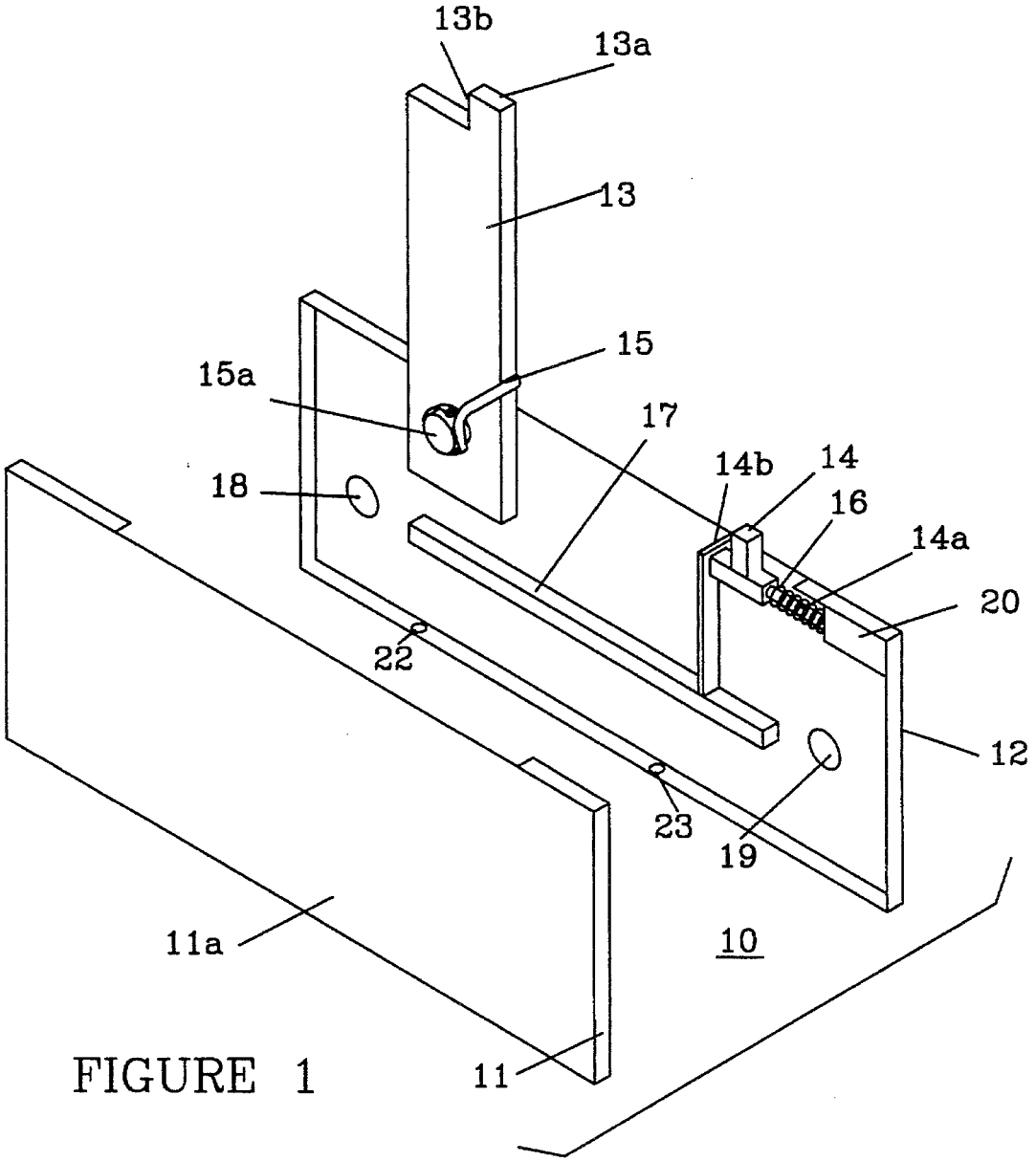
FIG. 1 is an exploded view of the mail box flag apparatus of the present invention.

FIG. 1 shows an exploded view of the mail box flag device 10 of the present invention. Device 10 has two rectangular sides 11 and 12 that, when joined together, form a housing in which flag 13 is pivotally attached to side 12 by pin 15*a*. Flag 13 is biased in a vertical direction by spring 15. Flag 13 is held in a horizontal position by latch 14 which slides on rod 14*a* into block 20. Spring 16 holds latch 14 to the left, as viewed in FIG. 1. Latch stop 14*b* holds latch 14 on pin 14*a* against spring 16. Support ledge 17 is positioned below flag 13 and prevents flag 13 from being pushed too far into housing 10.

Two holes, 18 and 19, are in side 12. These holes may be used to secure, using screws, side 12 to a mail box or mail box housing. Alternatively, a two sided adhesive may be used to secure side 12 to the mail box, or mail box housing.

Sides 11 and 12 join together to form housing 10. The two parts may be held together by friction when they are joined together, or screws (not illustrated) my be used to hold the two sides together. Side 11, for example, may be slightly larger than side 12 so that the peripheral edges of side 12 fit into the peripheral edges of side 11.

The out surface 11*a* of side 11 is finished or textured to match the surface to which it is attached. As illustrated in FIG. 1, the outer surface is textured to resemble the face of a brick, for purposes discussed below.

Figure 2:
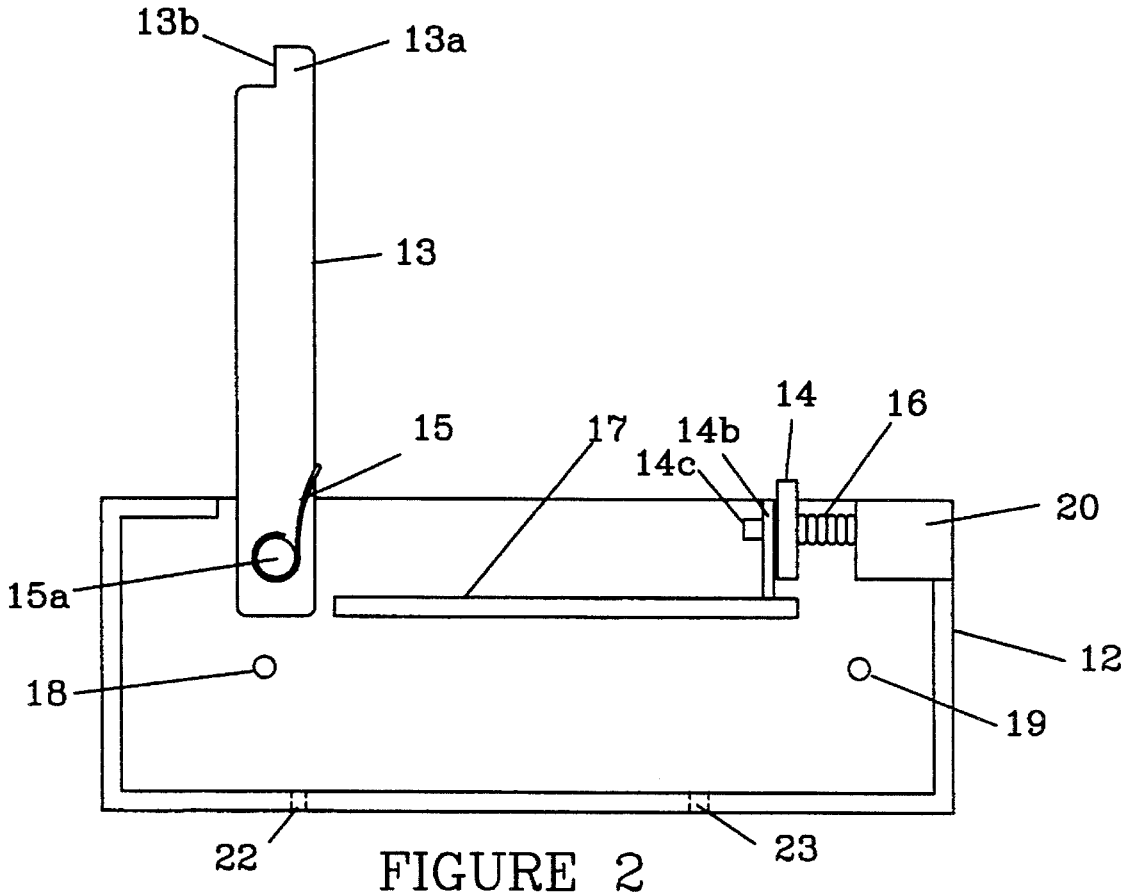
FIG. 2 is a side view of the flag apparatus with the cover removed, and the flag in a vertical position.

FIG. 2 is a side view of inside of side 12. Flag 13 is in a vertical position held vertically by spring 15. Flag 13 freely pivots on pin 15*a* allowing spring 15 to hold flag 13 in a vertical position. Spring 16, in its extended position, holds latch 14 to the left. Holes 22 and 23 provide drain holes so that water and moisture in housing 10 can drain out of the housing.

Figure 3:
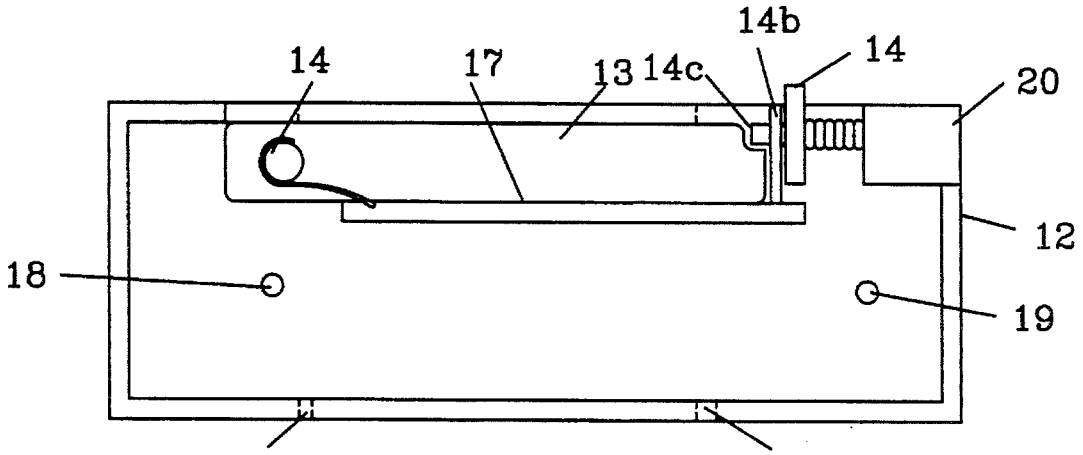
FIG. 3 is a side view of the flag apparatus with the cover removed, and the flag in a down, or horizontal position.

FIG. 3 is a side view of the inside of side 12 showing flag 13 in a horizontal stored position. End 13*a* of flag 13 is under latch 14 so that edge 13*b* is under latch end 14C, holding flag in the horizontal position. Flag 13 rests against stop 17, preventing flag 13 from being pushed to far into housing 10. When latch 14 and latch end 14C is pushed to the right, against spring 16, flag 13 is released, and spring 15 raises flag 13 to a vertical position.

Figure 4:
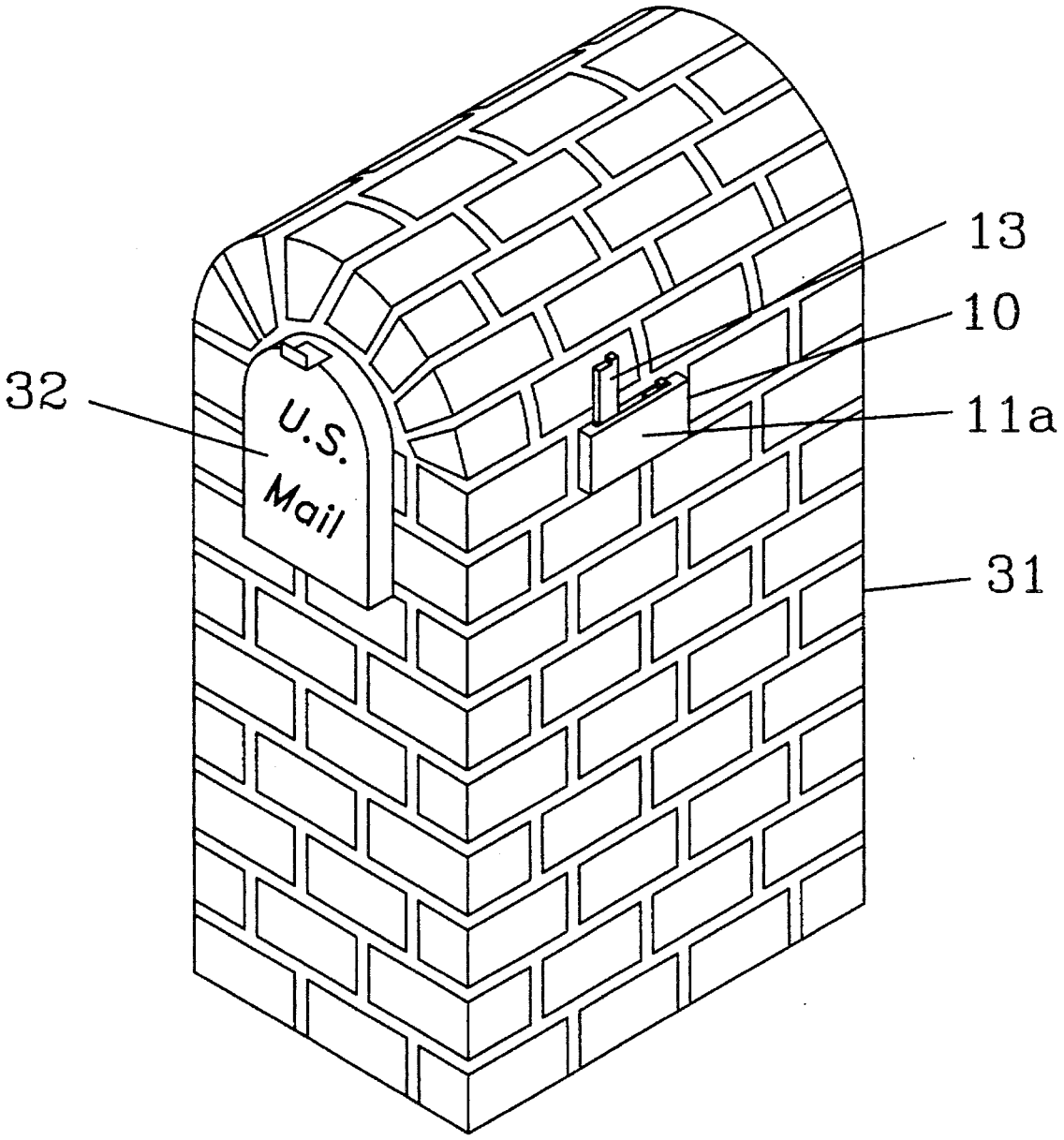
FIG. 4 show the flag apparatus on a brick housed mail box.

FIG. 4 illustrates a use of housing 10 and flag 13 with a brick housing for a mail box. For appearance and security purposes mail box 32 has been placed in a brick structure 31. With mail box 32 enclosed in brick structure 31, the mail box flag normally located on the side of the mail box cannot be used. In order to present a pleasant appearance, and not have housing 10 standout when flag 13 is not in use. The outer surface 11 is textured to look like the surrounding bricks. The texture can be made when the side 11 is molded, and then painted the same color as the bricks in structure 31, or a thin slice of the face of a brick may be attached to surface 11*a*.

Housing 10 may be either plastic or non-corrosive metal such as aluminum. In an alternate design, the outer surface 11*a* of side 11 may be covered with a night reflector so that structure 31 is visibly marked at night. Housing 10 can be attached to structure 31 by screws or an adhesive.

Various other changeable surface may be used for side 11 to enable housing 10 to match it surrounds.

What is claimed:

1. A mail box flag device operable and mountable independent from a mailbox, comprising:

a flag housing having first and second parts, and a flag mounting end and a latching end;

a flag having first and second ends, said first end rotatably mounted inside said housing at said mounting end;

a manually operative latch secured inside said housing at said latching end for engagement with said second end of said flag holding said flag in a horizontal position; and a textured surface on said first part.

2. The mail flag device according to claim 1, wherein said first part is textured to resemble a brick.

3. The mail flag device according to claim 1, including a notch on said flag second end, and a spring, said spring normally biasing said flag in a vertical position, and said latch interacting with said notch on said flag to hold said flag completely in said housing in a horizontal position.

4. The mail flag device according to claim 3, wherein said latch is biased in one direction by a spring away from said latching end to hold the flag in a horizontal position, and manually movable in a second direction, against the force of the spring, to allow the flag to move to a vertical position.

5. The mail flag device according to claim 1, wherein said second part is attached to a mounting surface independent of any mailbox, and the first part is frictionally clipped to said second part, said rotatably mounted end of said flag secured between said first and second parts.

6. The mail flag device according to claim 1, including a stop between said first and second parts and on said second part, horizontal to a lower edge of said second part and being of a length approximately the length of said flag, to limit the downward movement of said flag.

7. The mail flag device according to claim 1, including at least one drain hole in said housing to permit removal water and moisture from inside of said housing.

8. A mail box flag device operable and mountable independent from a mailbox, comprising:

a flag housing having first and second parts, and a flag mounting end and a latching end, a flag having first and second ends, said first end rotatably mounted in said housing;

a textured surface on said first part; and a manually operative latch secured inside said housing at said latching end for holding said flag in a horizontal position, a notch on the second end of said flag, and a spring, said spring normally biasing said flag in a vertical position, and said latch interacting with said notch on said flag to hold said flag in a horizontal position.

9. The mail flag device according to claim 8, wherein said second part is attached to a mounting surface, and the first part is frictionally attached to said second part, said rotatably mounted end of said flag, secured between said first and second parts.

10. The mail flag device according to claim 8, including a horizontal stop, inside flag housing on said second part to limit the downward movement of said flag.

11. The mail flag device according to claim 8, including at least one drain hole in a lower edge of said housing to permit removal of water and moisture from inside of said housing.

12. The mail flag device according to claim 8, wherein said latch is biased in one position by a spring, and manually moved in a second direction, against the force of the spring, to release the flag when the flag is secured in a horizontal position.

* * * * *